US008523615B2

(12) United States Patent
Luo et al.

(10) Patent No.: US 8,523,615 B2
(45) Date of Patent: Sep. 3, 2013

(54) COMPRESSION CONNECTOR CONFIGURED WITH TWO HOUSING LIMINTED CONTACTS THEREBETWEEN

(75) Inventors: Yu Luo, Shenzhen (CN); Xing-Liang Liu, Shenzhen (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 84 days.

(21) Appl. No.: 13/313,018

(22) Filed: Dec. 7, 2011

(65) Prior Publication Data

US 2012/0149248 A1 Jun. 14, 2012

(51) Int. Cl.
*H01R 12/00* (2006.01)

(52) U.S. Cl.
USPC ..... 439/660

(58) Field of Classification Search
USPC ..... 439/66, 709, 591, 71, 331, 625, 884, 439/862
See application file for complete search history.

(56) References Cited

U.S. PATENT DOCUMENTS

| | | | | |
|---|---|---|---|---|
| 7,878,818 | B2 | 2/2011 | Cheng | |
| 8,172,623 | B1 * | 5/2012 | Zhu | 439/709 |
| 8,267,701 | B2 * | 9/2012 | Beaman et al. | 439/68 |
| 8,282,431 | B1 * | 10/2012 | Zhang | 439/862 |
| 8,366,453 | B2 * | 2/2013 | Chang et al. | 439/70 |
| 2004/0203261 | A1 * | 10/2004 | DeFord et al. | 439/66 |
| 2009/0253287 | A1 * | 10/2009 | Polnyi et al. | 439/331 |
| 2009/0280689 | A1 * | 11/2009 | Lin et al. | 439/625 |
| 2009/0311900 | A1 * | 12/2009 | Liao | 439/331 |

* cited by examiner

*Primary Examiner* — Jean F Duverne
(74) *Attorney, Agent, or Firm* — Wei Te Chung; Ming Chieh Chang

(57) ABSTRACT

A compression connector for mounting to a print circuit board includes an insulative housing and a plurality of terminals received in the housing. The housing includes a first mating surface and a second mating surface opposite to the first mating surface. A number of terminal passageways are disposed between and running through the first and second mating faces. Each terminal includes a retaining section. Each of terminal passageway defines a retaining slot along a height direction orienting from the first mating surface to the second mating surface to receive the retaining section of the terminal and two limited portions at two ends of the retaining slot in the height direction so as to allow the retaining section to move in the height direction without dropping out.

10 Claims, 6 Drawing Sheets

COMPRESSION CONNECTOR CONFIGURED WITH TWO HOUSING LIMINTED CONTACTS THEREBETWEEN

BACKGROUND OF THE INVENTION

1. Field of the Invention

The present invention relates generally to a compression connector which is configured with two insulating housings to limit contacts therebetween.

2. Description of Related Arts

An electrical connector is disclosed in U.S. Pat. No. 7,878,818 issued to Cheng et al. on Feb. 1, 2011. Said connector includes an insulative housing and a number of terminals received in the housing. The housing has a top surface and a bottom surface opposite to each other. A number of terminal passageways are disposed through the top and bottom surfaces. Each of the terminals includes a base portion and two retaining portion extending from opposite sides of the base portion for securing the terminals in the terminal passageways. However, securing the terminals by this way generally causes the terminals break off the housing.

Hence, a compression connector to prevent terminals from breaking off the housing is desired.

SUMMARY OF THE INVENTION

Accordingly, an object of the present invention is to provide an electrical connector to prevent terminals from breaking off the housing.

To achieve the above object, a compression connector for mounting to two print circuit boards comprises an insulative housing and a plurality of terminals received in the housing. The housing includes a first mating surface and a second mating surface opposite to the first mating surface. A plurality of passageways is disposed between and run through the first and second mating faces. Each terminal includes a retaining section, two spring sections extending from opposite sides of the retaining section with contacting sections thereon which project outward the first and second mating surfaces respectively. Each of passageway defines a retaining slot along a height direction orienting from the first mating surface to the second mating surface to receive the retaining section of the terminal and two limited portions at two ends of the retaining slot in the height direction so as to allow the retaining section to move in the height direction without dropping out.

Other objects, advantages and novel features of the invention will become more apparent from the following detailed description when taken in conjunction with the accompanying drawings.

DETAILED DESCRIPTION OF THE PREFERRED EMBODIMENT

Figure 1:
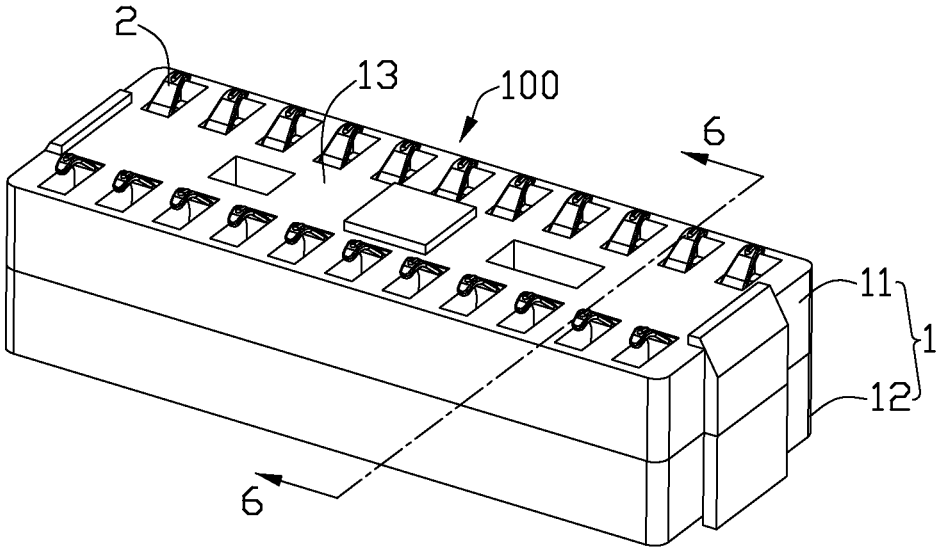
FIG. 1 is a perspective view of a compression connector in accordance with the present invention.

Reference will now be made to the drawing figures to describe the preferred embodiment of the present invention in detail.

Figure 2:
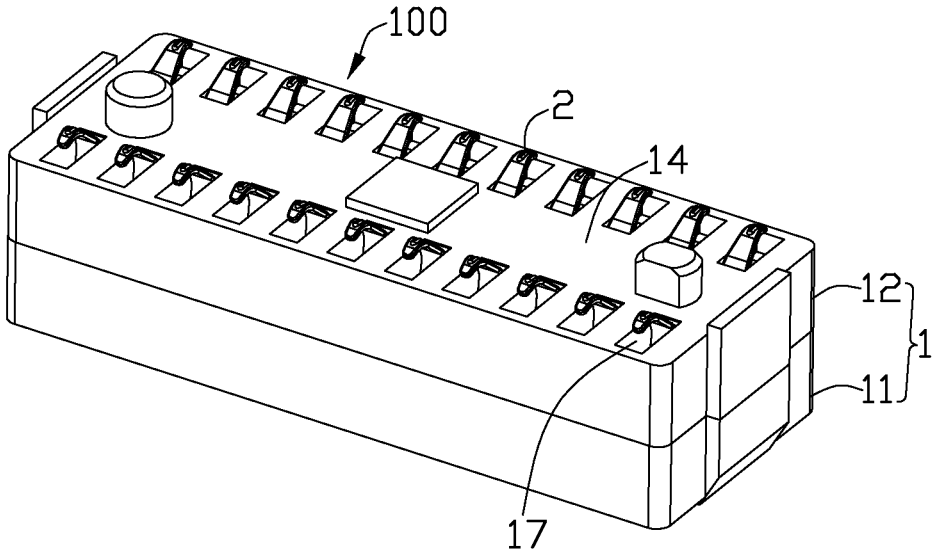
FIG. 2 is a perspective view of the compression connector from another view.

Referring to FIGS. 1 and 2, a compression connector 100 of the present invention, used for connecting with two print circuit boards (not shown), includes an insulative housing 1 and a plurality of terminals 2 received in the housing 1. The insulative housing 1 includes a first housing 11 and a second housing 12 combining with the first housing 11, the first housing defines a first mating surface 13 and the second housing 12 defines a second mating surface 14 opposite to the first mating surface. A number of passageways 17 are disposed running through the first and second mating surfaces, the number of passageways are divided into two rows extending along a longitudinal direction of the insulative housing 1.

Figure 3:
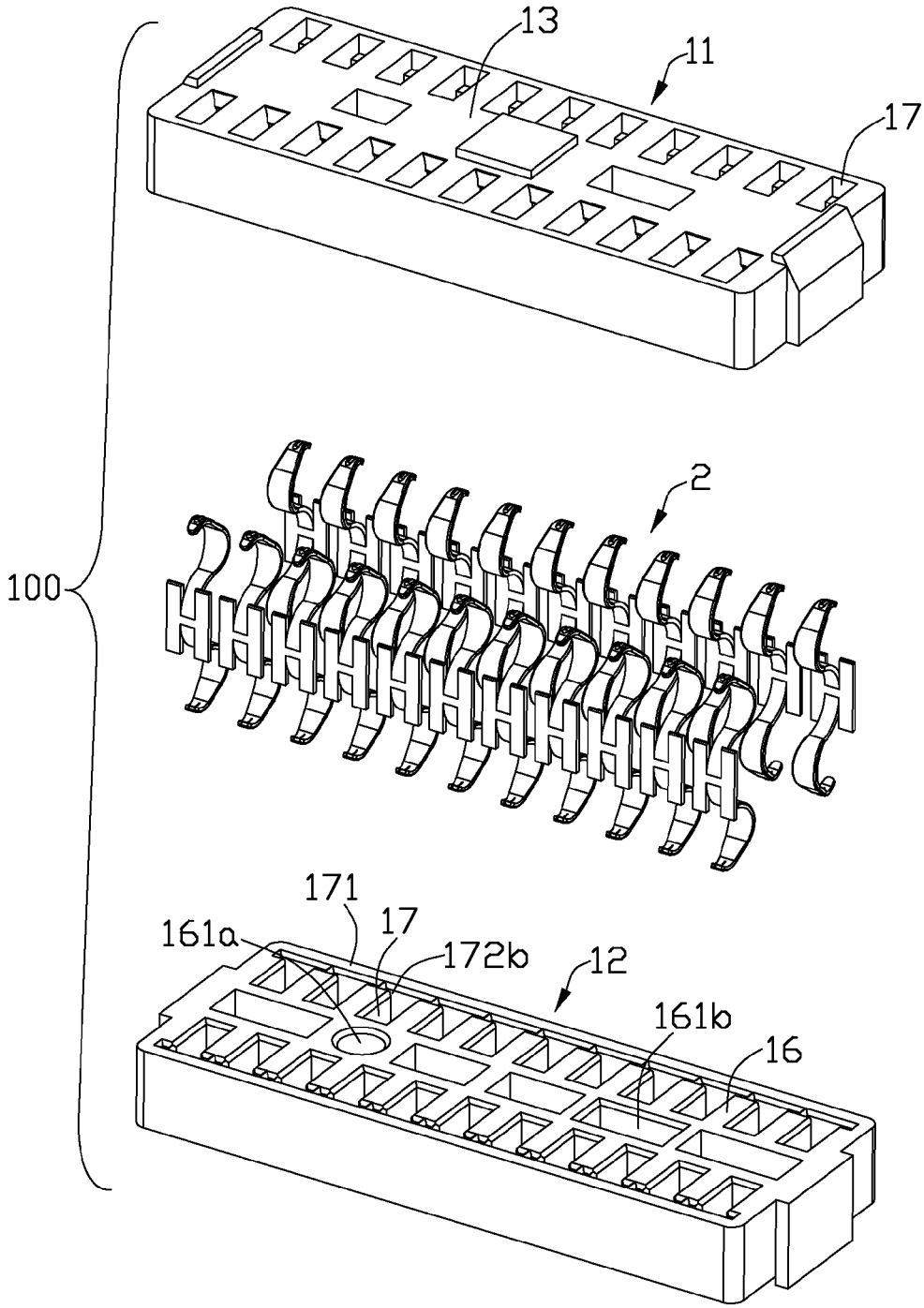
FIG. 3 is an exploded perspective view of the compression connector shown in FIG. 1.
Figure 4:
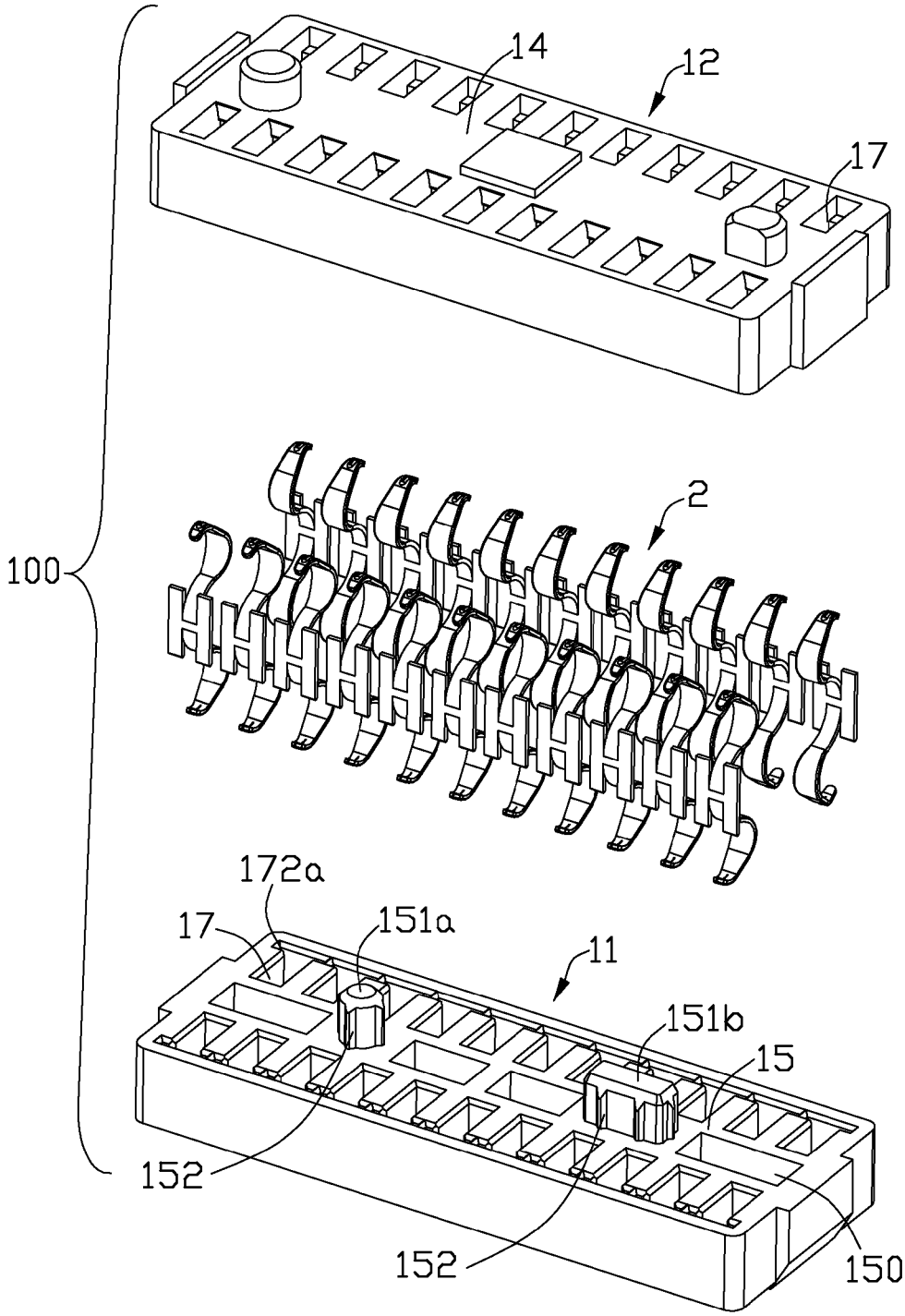
FIG. 4 is an exploded perspective view of the compression connector shown in FIG. 3.

Referring to FIGS. 3 and 4, the first housing 11 defines a first contacting surface 15 opposite to the first mating surface 13 and the second housing 12 defines a second contacting surface 16 opposite to the second mating surface 14 and to confront with the first contacting surface 15. The passageways 17 of housing 1 includes a retaining slot 172*a*, 172*b* on opposite side walls 171 of the first and the second housings 11,12 respectively, which are running through the first and second contacting surfaces 15, 16 respectively, not through the first and second mating surfaces 13, 14. Detail Referring to FIG. 6, when the first housing 11 is mounted together with the second housing 12, the first contacting surface 15 confronts with the second contacting surface 16 and two retaining slots 172*a*, 172*b* are combined to a common retaining slot 172. The retaining slot 172 is disposed in a height direction oriented from the first mating surface 13 to the second mating surface 14 and partitioned from the first and second mating surface 13, 14 with limiting portions or walls 1721 facing to each other and perpendicular to the height direction. An inner side wall 173 is disposed opposite to the outer side wall 171 to separate said two rows of passageways in a transverse direction perpendicular to the longitudinal direction. The inner side wall 173 near the first and second mating surface 13, 14 are provided with arc portions 174 which slant with a tendency to terminal passageways 17.

Back referring to FIGS. 3 and 4, a number of rectangular holes 150 is set along the longitudinal direction of the first housing 11 between said two rows of the passageways and guide posts 151*a*, 151*b* are arranged between the holes 150. The two guiding posts are in different shape for mis-mating of said first and second housing, one guide post 151*a* is in a cylinder shape and another guide post 151*b* is in a rectangle shape. When the first and second housing are assembled together, the guiding posts 151*a*, 151*b* are inserted and retaining in corresponding guide holes 161*a*, 161*b* defined on the second housing. The guiding posts further define guiding rib 152 at an outer periphery of the posts along the height direction so as to interference with the guiding holes of the second housing for further retention.

Figure 5:
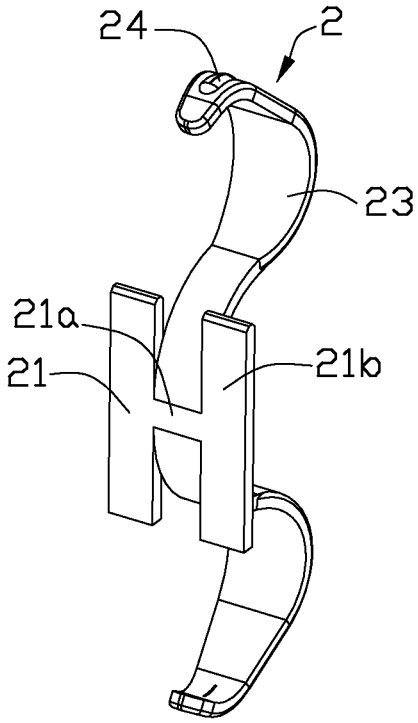
FIG. 5 is a perspective view of a terminal of the compression connector.
Figure 6:
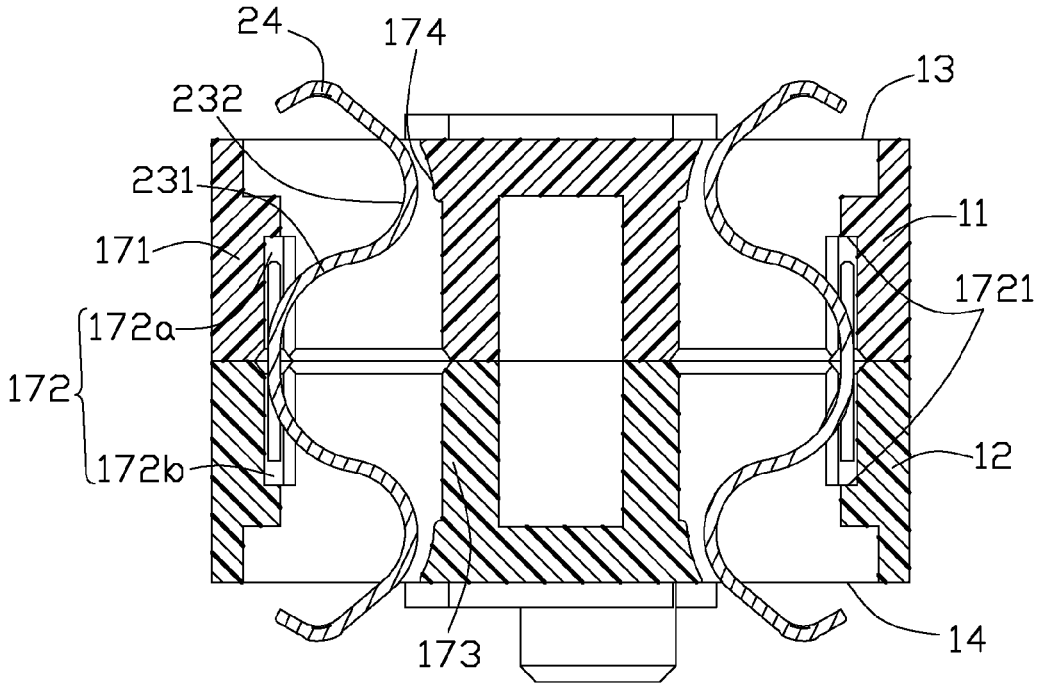
FIG. 6 is a cross section view of the compression connector taken along a broken line 6-6 in FIG. 1.

Referring to FIG. 5, the plurality of terminals 2 is symmetrical received in the two rows of passageways 17. Each of the terminal 2 includes a retaining section 21, two spring sections 23 symmetrically extending from an upper and lower edges of the retaining section. In the preferred embodiment, said retaining section 21 is in "H" shape which includes a transverse portion 21*a* and two vertical portions 21*b* located on both sides of the transverse portion 21*a*. Said two spring sections 23 split from the retaining section and extend from opposite sides of the transverse portion 21*a*, thereby said two vertical portions 21*b* being configured at both sides of the spring section 23. Said two the retaining sections 23 are located at a same side of the retaining portion, the spring sections extend away from said same side and then bend transversely towards the retaining section, therefore the free ends of the spring section are located substantially above the retaining section or adjacent to the retaining section with a contacting portion 24 at top thereof. Referring to FIG. 6, the contacting sections 24 project outwards the first and second mating surfaces respectively, the two rows of contacting sections orient in opposite directions. Each spring section 23 includes two arc shape sections 231, 232 continued in turn from a root thereof The first arc shape section 231 opens orienting to the inner side wall 173 and the second arc shape section 232 opens orienting to the outer side wall 171, wherein the retaining slots disposed. The second arc shape section 232 has a similar shape to the arc portion 174 so that the second arc shaped section will press on the arc portion 174 when the spring section is deformed downwardly into the passageway by the PCB. The retaining section 21 and two spring sections 23 are commonly formed as a shape similar to a bow for big compression, an appropriate distance between the spring section and the inner side wall 173 for terminals with a appropriate deformation space.

The terminals are inserted into one of the first and second housing and then the other one of the first and second housing are combined with said one of the first and second housing. Said the retaining sections 21 of the terminals are received in retaining slot 172 or the retaining slot 172*a*. The length of the retaining section 21 is shorter than the length of the retaining slot 172 in the height direction so that the retaining sections are limited in the retaining slot by the limited portions 1721 and do a slight movement between limited portions. The slight movement allow the terminals adjust to a preferred work statue during the terminals are pressed inwards by the PCB.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. A compression connector comprising:

an insulative housing defining a first mating surface and a second mating surface opposite to the first mating surface and defining a plurality of passageways disposed between and running through the first and second mating faces; and a plurality of terminals received and retained in the passageways, each of the terminal comprising a retaining section, two spring sections each with a contacting section thereof projecting outwards the first and second mating surfaces respectively;

wherein the passageway defines retaining slots along a height direction orienting from the first mating surface to the second mating surface to receive the retaining sections of the terminals and two limited portions at two ends of the retaining slots in the height direction to prevent the retaining sections from dropping out of the retaining slots in the height direction wherein the retaining section is shorter than the retaining slot in the height direction; wherein the passageways are divided into two rows extending along a longitudinal direction of the insulative housing, the two rows of contacting sections orient in opposite directions; wherein the insulative housing comprises a first housing and a second housing combining with the first housing, the first housing defines a first contacting surface opposite to the first mating surface and the second housing defines a second contacting surface opposite to the second mating surface, the retaining slots of the passageways are defined running through the first and second contacting surfaces respectively, while not through the first and second mating surfaces.

2. The compression connector as claimed in claim 1, wherein the two spring sections of each terminal extend symmetrically from an upper and lower portions of the retaining section and are located as a same side of the retaining section.

3. The compression connector as claimed in claim 2, wherein each passageway has an inner side wall and an outer side wall opposite to the inner side wall, the retaining slots are disposed on the outer side wall.

4. The compression connector as claimed in claim 3, wherein the inner side wall and the outer side wall separate said two rows of passageways in a transverse direction perpendicular to the longitudinal direction.

5. The compression connector as claimed in claim 4, wherein each spring section has a first arc shape section opens orienting to the inner side wall and a second arc shape section opens orienting to the outer side wall.

6. The compression connector as claimed in claim 5, wherein the inner side wall near the first and second mating surface are provided with arc portions which slant with a tendency to the passageways, the second arc shape section has a similar shape to the arc portion.

7. The compression connector as claimed in claim 6, wherein the first housing defines two guiding posts which are retained in two guiding holes defined on the second housing, the two guiding posts are in different shape.

8. A compression connector comprising:

a first insulating housing defining a plurality of first retaining slots running through a first contacting surface thereof, a plurality of terminals comprising retaining sections and two spring arms extending from opposite edges of the retaining sections, the retaining sections being inserted into the first retaining slots from the first contacting surface and one of said two spring arm extending to a first mating surface opposite to the first contacting surface of the first insulating housing;

a second insulating housing defining a plurality of second retaining slots running through a second contacting surface thereof, the second insulating housing being assembled with the first insulating housing and the second retaining slots being inserted with said retaining section of the terminals thereby the retaining sections of the terminals being limited in the first and second retaining slots and another spring arms extending to a second mating surface opposite to the second contacting surface wherein the retaining slots do not run through the first and second mating surfaces.

9. An electrical connector assembly comprising:

a first housing defining a coupling face and a mounting face opposite to each other in a vertical direction;

a plurality of first passageways extending through the first housing in the vertical direction, each of the first passageways being equipped with a first stopping step facing toward the coupling face;

a second housing defining a coupling surface and a mating surface opposite to each other in the vertical direction;

a plurality of second passageways extending through the second housing in the vertical direction, each of the second passageways being equipped with a second stopping step facing toward the coupling surface; and a plurality of contacts disposed in the corresponding first passageways, respectively, under condition that each of said contacts defining opposite resilient contacting sections and opposite retention sections; wherein the first housing and the second housing are assembled to each other with the coupling face and the coupling surface coupled together in the vertical direction, the first passageways and the second passageways are aligned with each other in the vertical direction, respectively, the opposite resilient contacting sections extend beyond the mating face and the mating surface in the vertical direction, respectively, and the opposite retention sections are sandwiched between the first stopping step and the second stopping step in the vertical direction wherein both the mating surface and the mounting face are equipped with corresponding standoffs, respectively; wherein said mounting face is further equipped with a mounting post while the mating surface is not; wherein the standoffs are located in middle regions of said mounting face and the mating surface; wherein the standoff on the first housing is located essentially outside of a corresponding end face while the standoff on the second housing is located essentially inside of a corresponding end face.

10. The electrical connector assembly as claimed in claim 9, wherein one of coupling face and the coupling surface is equipped with a guide post while the other is equipped with a guide hole for coupling with the guide post.

* * * * *